US005660915A

United States Patent [19]

Schoeps et al.

[11] Patent Number: 5,660,915

[45] Date of Patent: Aug. 26, 1997

[54] BITUMINOUS ROOFING UNDERFELT AND BASE FELT THEREFOR

[75] Inventors: Michael Schoeps, Grossaitingen; Bertrand Claude Weiter; Franz Kaulich, both of Bobingen, all of Germany

[73] Assignee: Hoechst Aktiengesellschaft, Frankfurt, Germany

[21] Appl. No.: 131,093

[22] Filed: Oct. 1, 1993

[30] Foreign Application Priority Data

Oct. 2, 1992 [DE] Germany ..... 42 33 204.4

[51] Int. Cl.[6] ..... B32R 11/10

[52] U.S. Cl. ..... 428/141; 428/156; 428/170; 428/213; 428/171; 428/219

[58] Field of Search ..... 428/141, 156, 428/170, 171, 213, 219, 224, 280, 289, 291, 288, 296

[56] References Cited

U.S. PATENT DOCUMENTS

| | | | |
|---|---|---|---|
| 4,342,804 | 8/1982 | Meynard . | |
| 4,987,027 | 1/1991 | Zerfass et al. | 428/287 |
| 5,130,178 | 7/1992 | Zerfass et al. | 428/198 |
| 5,173,355 | 12/1992 | Vock et al. | 428/219 |
| 5,219,635 | 6/1993 | Welter et al. . | |
| 5,219,647 | 6/1993 | Vock et al. . | |

FOREIGN PATENT DOCUMENTS

| | | |
|---|---|---|
| 0027750 | 8/1984 | European Pat. Off. . |
| 0 453 968 A2 | 10/1991 | European Pat. Off. . |
| 0453968 | 10/1991 | European Pat. Off. . |
| 0 455 990 A1 | 11/1991 | European Pat. Off. . |
| 2 240 860 | 2/1974 | Germany . |
| 25 26 749 | 10/1976 | Germany . |
| 30 15 416 | 11/1981 | Germany . |
| 4008043 | 9/1991 | Germany . |
| 2 198 756 | 6/1988 | United Kingdom . |

*Primary Examiner*—Marion E. McCamish
*Assistant Examiner*—Elizabeth M. Cole

[57] ABSTRACT

There is described a bituminous roofing underfelt comprising a spunbond of polyester, in particular polyethylene terephthalate, filaments having a filament linear density of 1–8 dtex embedded in a bitumen matrix, wherein the weight of the bitumen accounts for from 40 to 90% and that of the spunbonded for from 10 to 60% of the basis weight of the roofing underfelt, and the spunbond is consolidated by a meltable binder whose melting point is below the processing temperature of the bitumen used in making the bituminous roofing underfelt and which is present in the spunbonded in a weight proportion of from 5 to 20% of the total weight. The spunbonded preferably bears an embossed pattern, for example a plain-weave embossment. There is also described a process for manufacturing the roofing underfelt and the spunbond present therein.

22 Claims, No Drawings

BITUMINOUS ROOFING UNDERFELT AND BASE FELT THEREFOR

The present invention relates to a roofing underfelt of improved water vapor permeability, a base felt for this roofing underfelt, and to processes for manufacturing these articles.

Roofing underfelts (also known as sarking or underslating felts) are, as will be known, employed underneath the tiles or slates of pitched roofs to keep out wind-driven rain, snow, dust and the like. Roofing underfelts should combine water impermeability with air and vapor permeability. They should also have high strength, in particular a high tongue tear strength, for example in order to be able to hold the weight of a roofer in the event of an accident. Roofing underfelts made of mesh-reinforced plastic sheets are in widespread use. It is true that these sheets have good breaking strength, but their tongue tear strength remains unsatisfactory and frequently their vapor permeability too.

EP-B-0027750 describes a roofing underfelt base felt comprising a fiber web of polypropylene, polyethylene, polyester or polyvinyl and having a basis weight between 85–200 g/m$^2$. To manufacture the roofing underfelt, the fiber web is provided on one side with a layer of bitumen by coating the fiber web with hot bitumen and then subjecting it to cooling to create microholes or microcracks. The microholes or microcracks of this known roofing underfelt are to improve the vapor permeability. DE-A-40 08 043 discloses a roofing underfelt base felt comprising a spunbonded of polyester, in particular polyethylene terephthalate, filaments, the spunbonded having a basis weight of 50–100 g/m$^2$ when the filament linear density is 1–8 dtex and having been consolidated by a meltable binder. The melting point of the meltable binder should advantageously be 10° C., preferably 30° C., below the melting point of the load-bearing filaments. According to this reference, meltable binders made of polyester, preferably polybutylene terephthalate or modified polyethylene terephthalate, are particularly highly suitable. It is further stated in this reference that base felts made of polypropylene having a softening point of about 156° C. are less suitable for bituminization. The base felt known from this reference has a tongue tear strength of about 20 to 80N.

EP-A-453 968 discloses a formwork sheet comprising a spunbonded of an organic fiber-forming material which has been rendered waterproof with a coating and which bears on at least one surface a structure in the form of a weave pattern which was embossed onto the spunbond in the course of its manufacture and which serves to enhance the slip resistance.

The known bituminous roofing underfelts, which all have good mechanical strength properties, are still not fully satisfactory as regards water vapor permeability. The present invention, then, provides a bituminous roofing underfelt which, compared with known roofing underfelts, possesses significantly improved vapor permeability.

The bituminous roofing underfelt of the invention comprises a spunbond of polyester, in particular polyethylene terephthalate, filaments having a filament linear density of 1–8 dtex embedded in a bitumen matrix, and in it the weight of the bitumen accounts for from 40 to 90% and that of the spunbond for from 10 to 60% of the basis weight of the roofing underfelt, and the spunbonded is consolidated by a meltable binder whose melting point is below the processing temperature of the bitumen used in making the bituminous roofing underfelt and which is present in the spunbond in a weight proportion of from 5 to 20% of the total weight.

Apart from the condition that the processing temperature of the bitumen is higher than the melting point of the meltable binder used for consolidating the spunbond, the bitumen matrix of the roofing underfelt of the invention can comprise any known grade of bitumen suitable for impregnating purposes, including in particular polymer-modified bitumen.

The meltable binder used for consolidating the spunbond advantageously has a melting point of 150°–180° C. Using this type of meltable binder it is possible to achieve the abovementioned condition that the impregnation with bitumen shall take place at a temperature which is above the melting point of the meltable binder used for consolidating the spunbond under customary bituminizing conditions and using customary bitumen materials.

The meltable binder for the spunbond to be used according to the invention is particularly preferably a polypropylene meltable binder, which is particularly advantageously incorporated in the spunbonded in the form of binder fibers. Advantageously the melt flow index of the polypropylene used as meltable binder is within the range from 150° to 180° C., preferably within the range from 155° to 175° C. In a further preferred embodiment, the bituminous roofing underfelt of the invention comprises a spunbond which has been consolidated as described above and which bears an embossed pattern made up of randomly distributed or regularly repeating small embossments, preferably a plain-weave embossment, in which the pressed area, i.e. the total area of all thin, densified regions of the spunbond, accounts for 30–60%, preferably 40–45%, of the total area and the thickness difference between densified and nondensified regions of the spunbond is at least 25%, preferably 30–50%.

The spunbond present in the bituminous roofing underfelt of the invention advantageously has a basis weight of 50–250 g/m$^2$, preferably 80–120 g/m$^2$, a thickness of about 0.2–0.6, preferably 0.25–0.4, mm and an extensibility of 20–40%. The breaking strength for the spunbond implemented in the bituminous roofing underfelts of the invention is 10–25 daN, measured on a 5 cm wide strip.

The present invention further provides the base felt present in the preferred embodiment of the bituminous roofing underfelt of the invention. This base felt comprises a spunbonded of polyester, in particular polyethylene terephthalate, filaments having a filament linear density of 1–8 dtex and which bears an embossed pattern made up of randomly distributed or regularly repeating small embossments, preferably a plain-weave embossment, in which the pressed area, i.e. the total area of all thin, densified regions of the spunbond, accounts for 30–60%, preferably 40–45%, of the total area and the thickness difference between densified and nondensified regions of the spunbonded is at least 25%, preferably 30–50%, and is consolidated by a meltable binder whose melting point is below the processing temperature of the bitumen used in making the bituminous roofing underfelt and which is present in the spunbond in a weight proportion of from 5 to 20% of the total weight. It is assumed that the embossed pattern on the base felt of the invention too contributes to the enhanced water vapor permeability of the bituminous roofing underfelt of the invention. This embossed pattern, which is applied to both surfaces of the spunbond, but preferably only to one surface of the spunbond, as it passes through a hot calender, comprises a multiplicity of small embossments which are 0.2–40 mm$^2$ in size and are spaced apart by in-between unembossed flat elements of the web of approximately equal size. Crucial for the improved water vapor permeability of the bituminous roofing underfelt of the invention is the use for the consolidation of the base felt of a meltable binder whose melting point is below the temperature at which the base felt is bituminized. Advantageously the bituminizing temperature and the melting point of the meltable binder are adapted to one another in such a way that the melting point of the meltable binder is at least 1° C., preferably 10°–30° C., below the processing temperature of the bitumen used in making the bituminous roofing underfelt.

A meltable binder which is particularly preferred for consolidating the base felt of the invention is made of polypropylene. It is particularly advantageous to incorporate this meltable binder into the spunbond of the base felt in the form of binder fibers.

The base felt of the invention advantageously has a basis weight of 50–250 g/m$^2$, preferably 80–120 g/m$^2$, and a thickness of 0.2–0.6, preferably 0.25–0.4, mm. Its breaking strength, measured on a 5 cm wide strip, is 10–25 daN and it has an extensibility of 20–40%.

The present invention further provides for the use of the base felt of the invention comprising a spunbond of polyester, in particular polyethylene terephthalate, filaments having a filament linear density of 1–8 dtex consolidated by a meltable binder present in the spunbond in a weight proportion of from 5 to 20% of the total weight, for manufacturing bituminous roofing underfelts using a bitumen whose processing temperature is above the melting point of the meltable binder. Preference is given to using such a base felt when it bears an embossed pattern made up of randomly distributed or regularly repeating small embossments, preferably a plain-weave embossment, in which the pressed area, i.e. the total area of all thin, densified regions of the spunbonded, accounts for 30–60%, preferably 40–45%, of the total area and the thickness difference between densified and nondensified regions of the spunbond is at least 25%, preferably 30–50%.

The bituminous roofing underfelt of the invention is manufactured by laying down continuous load-bearing polyester filaments and binder filaments having a filament linear density of 1–8 dtex, which were spun side by side, to form a random web and impregnating same with bitumen in a conventional manner, which comprises laying down, based on the total laydown, from 5 to 20% by weight of binder filaments, consolidating the web by heat treatment at a temperature between the melting points of the load-bearing filaments and binder filaments and impregnating the resulting spunbond at a temperature which is above the melting point of the binder filaments with sufficient bitumen for the weight proportion thereof in the ready-manufactured roofing underfelt to be from 40 to 90% by weight, preferably with from 200 to 1000 g/m$^2$ of bitumen.

Preferably the melting point of the binder and the bituminization temperature are adapted to one another in such a way that the melting point of the meltable binder is at least 1° C., preferably 10–30° C., below the temperature of the bitumen bath. In a particularly preferred embodiment for manufacturing the bituminous roofing underfelt of the invention, the spunbonded is prior to impregnation with bitumen provided by calendering at 180°–250° C., on both sides but preferably on one side, with an embossed pattern made up of randomly distributed or regularly repeating small embossments, preferably a plain-weave embossment, in which the pressed area, i.e. the total area of all embossed, densified regions of the spunbond, accounts for 30–60%, preferably 40–45%, of the total area and the thickness difference between densified and nondensified regions of the spunbond is at least 25%, preferably 30–50%.

In accordance with the above directions concerning the manufacture of the bituminous roofing underfelt of the invention, the base felt used in the manufacture of a preferred embodiment of the bituminous roofing underfelt of the invention is manufactured by laying down continuous load-bearing polyester filaments and binder filaments having a filament linear density of 1–8 dtex, which were spun side by side, to form a random web in a conventional manner, which comprises laying down, based on the total laydown, from 5 to 20% by weight of binder filaments whose melting point is below the processing temperature of the bitumen used in making the bituminous roofing underfelt, consolidating the web by heat treatment at a temperature between the melting points of the load-bearing filaments and binder filaments, and providing it by calendering at 180°–250° C. with an embossed pattern made up of randomly distributed or regularly repeating small embossments, preferably a plain-weave embossment, in which the pressed area, i.e. the total area of all embossed, densified regions of the spunbond, accounts for 30–60%, preferably 40–45%, of the total area and the thickness difference between densified and nondensified regions of the spunbond is at least 25%, preferably 30–50%.

Suitable polyesters for the base felt present in the bituminous roofing underfelt are those having terephthalic acid and ethylene glycol as main components. In addition to the basic building blocks mentioned, these polyesters may contain further, modifying dicarboxylic acid or diol units, for example radicals of isophthalic acid, aliphatic dicarboxylic acid having in general 6–10 carbon atoms, sulfoisophthalic acid, radicals of longer diols having in general 3–8 carbon atoms, ether-diols, for example diglycol or triglycol radicals or else small proportions of polyglycol radicals. These modifying components are in general present as cocondensed units in the polyester in a proportion of not more than 15 mol %, preferably not more than 5 mol %. The base felt of the invention and the bituminous roofing underfelt of the invention are preferably manufactured using spunbond of fibers made of polyethylene terephthalate containing less than 5 mol % of modifying components, but in particular made of pure unmodified polyethylene terephthalate. The following illustrative embodiments explain the manufacture of a base felt according to the invention and its use for manufacturing a bituminous roofing underfelt according to the invention by way of example.

EXAMPLE 1

The spinning manifold of an experimental spinning plant equipped with jets for spinning polyethylene terephthalate and jets for spinning polypropylene extrudes per minute 44 g of polyethylene terephthalate and 13 g of polypropylene. The filament curtain is drawn in an injector nozzle and random-laid down via a rotating impact plate with downstream guide surface on a conveyor belt, producing a web weight of about 98–103 g/m$^2$. In accordance with the ratio of the amounts of polyethylene terephthalate and polypropylene extruded per minute, the web contains 9% by weight of randomly distributed polypropylene filaments. The web formed on the conveyor belt passes into an embossing calender set to a temperature of 210° C., which embosses the web on one side with a plain-weave pattern. The calender nip pressure was 50 daN per cm. The speed of the web through the calender was 14 m/min.

The base felt thus obtained had the properties shown in Table 1 under run no. 1a. Increasing the nip pressure of the calender from 50 daN/cm to 60 daN/cm produces the web properties shown in Table 1 under run 1b.

Runs 1c to 1h were carried out to determine the effect of varying the calender temperature and the nip pressure of the calender. The results obtained are likewise shown in Table 1.

TABLE 1

| | 1a | 1b | 1c | 1d | 1e | 1f | 1g | 1h |
|---|---|---|---|---|---|---|---|---|
| Basis weight [g/m²] | 98.6 | 97.7 | 101.2 | 100.3 | 101.5 | 97.6 | 101.1 | 100 |
| Thickness [mm] | 0.35 | 0.33 | 0.32 | 0.31 | 0.32 | 0.32 | 0.31 | 0.30 |
| Breaking strength along/across [daN/5 cm] | 16.1/ 14.6 | 14.1/ 14.7 | 16.4/ 16.7 | 16.2/ 16.5 | 17.1/ 16.7 | 19.5/ 19.5 | 20.0/ 18.9 | 19.3/ 20.9 |
| Extensibility along/across [%] | 38.3/ 33.2 | —/ 33.4 | 29.5/ 29.7 | 29.0/ 25.0 | 29.0/ 24.5 | 20.2/ 22.6 | 23.0/ 20.4 | 21.0/ 20/8 |
| Shrinkage along/across | 1.2/ 0.0 | 1.2/ 0.0 | 1.2/ 0.0 | 1.4/ 0.0 | 1.2/ 0.0 | 1.4/ 0.0 | 1.3/ 0.0 | 1.4/ 0.1 |
| Tongue tear strength along/across [daN] | 13.1/ 11.4 | 12.4/ 12.0 | 14.1/ 13.8 | 15.0/ 13.8 | 13.2/ 13.0 | 15.6/ 15.3 | 14.5/ 14.6 | 13.8/ 13.9 |
| Nail retention strength along/cross [N] | 103/ 110 | 101/ 110 | 120/ 136 | 113/ 116 | 106/ 112 | 110/ 111 | 118/ 121 | 109/ 116 |
| Calender setting nip pressure [daN/cm]/ temperature [°C.] | 50/ 210 | 60/ 210 | 50/ 230 | 60/ 230 | 80/ 230 | 40/ 250 | 50/ 250 | 80/ 250 |

EXAMPLE 2

The spinning manifold of an experimental spinning plant equipped with jets for spinning polyethylene terephthalate and jets for spinning polypropylene extrudes per minute 44 g of polyethylene terephthalate and 17 g of polypropylene. The filament curtain is drawn in an injector nozzle and random-laid down via a rotating impact plate with downstream guide surface on a conveyor belt, producing a web weight of about 98–103 g/m². In accordance with the ratio of the amounts of polyethylene terephthalate and polypropylene extruded per minute, the web contains 11% by weight of randomly distributed polypropylene filaments. The web formed on the conveyor belt passes into an embossing calender set to a temperature of 210° C., which embosses the web on one side with a plain-weave pattern. The calender nip pressure was 50 daN per cm. The speed of the web through the calender was 14 m/min.

The base felt thus obtained had the properties shown in Table 2 under run no. 2a. Increasing the nip pressure of the calender from 50 daN/cm to 60 daN/cm produces the web properties shown in Table 2 under run 2b.

Runs 2c to 2h were carried out to determine the effect of varying the calender temperature and the nip pressure of the calender. The results obtained are likewise shown in Table 2.

TABLE 2

| | 2a | 2b | 2c | 2d | 2e | 2f | 2g | 2h |
|---|---|---|---|---|---|---|---|---|
| Basis weight [g/m²] | 101 | 100 | 103 | 100 | 99.6 | 102 | 104 | 103 |
| Thickness [mm] | 0.35 | 0.34 | 0.32 | 0.32 | 0.32 | 0.31 | 0.31 | 0.31 |
| Breaking strength along/across [daN/5 cm] | 15.8/ 16.2 | 16.1/ 17.0 | 19.5/ 20.3 | 19.1/ 20.2 | 19.5/ 18.2 | 22.2/ 23.2 | 22.4/ 23.1 | 20.7/ 21.9 |
| Extensibility along/across [%] | 34.6/ 37.2 | 36.2/ 41.7 | 27.6/ 32.7 | 27.3/ 30.7 | 28.2/ 24.0 | 27.1/ 25.5 | 28.8/ 28.7 | 23.6/ 25.5 |
| Shrinkage along/across | 1.3/ 0.0 | 1.1/ 0.0 | 1.3/ 0.0 | 1.3/ 0.0 | 1.5/ 0.0 | 1.2/ 0.0 | 1.2/ 0.0 | 1.4/ 0.0 |
| Tongue tear strength along/across [daN] | 12.7/ 22.4 | 12.3/ 12.7 | 14.7/ 14.6 | 15.0/ 13.8 | 14.8/ 13.3 | 14.7/ 14.9 | 14.5/ 12.9 | 16.8/ 14.7 |
| Nail retention strength along/across [N] | 100/ 110 | 98/ 98 | 110/ 130 | 116/ 111 | 112/ 123 | 115/ 119 | 123/ 114 | 94/ 120 |
| Calender setting | 50/ 210 | 60/ 210 | 50/ 230 | 60/ 230 | 80/ 230 | 40/ 250 | 50/ 250 | 60/ 250 |

TABLE 2-continued

| | 2a | 2b | 2c | 2d | 2e | 2f | 2g | 2h |
|---|---|---|---|---|---|---|---|---|
| nip pressure [daN/cm]/ temperature [°C.] | | | | | | | | |

EXAMPLE 3

The polypropylene-bonded base felt produced in Example 1 with plain-weave embossment was provided in a customary impregnat at 170° C. with an add-on of 200 g/m$^2$ of a polymer-modified bitumen based on SBS (styrene/butadiene/styrene copolymer) and the resulting bitumen felt was cooled on chill rolls to about room temperature. In accordance with the bitumen add-on, the basis weight of the ready-produced felt was about 300 g/m$^2$.

For comparison, a conventional base felt comprising a polyethylene terephthalate web melt-bonded with 9% by weight of polybutylene terephthalate filaments and having a basis weight of 100 g/m$^2$ was impregnated in the same way with the same amount per m$^2$ of the same polymer-modified bitumen.

The bituminous roofing underfelt of the invention had a water vapor permeability, measured by the method of DIN 52 615, of 8.2 g/m$^2$ per day, whereas the roofing underfelt produced from the conventional polybutylene terephthalate-bonded spunbond had a water vapor permeability, measured by the method of DIN 52 615, of only 0.7 g/m$^2$ per day.

What is claimed is:

1. A roofing material comprising a spunbond of polyester filaments which have a filament linear density of 1–8 dtex and which bear an embossed pattern made up of randomly distributed or regularly repeating small embossments having thin, densified regions and nondensified regions, and wherein the thin, densified regions of the spunbond, accounts for 30–60% of the spunbond's total area and the spunbond has a thickness difference between densified and nondensified regions of at least 25% and being consolidated by a meltable binder whose melting point is from 150° C. to 175° C. and said meltable binder is present in the spunbond in a weight proportion of from 5 to 20% of the total weight of the spunbond.

2. The roofing material as claimed in claim 1, wherein the meltable binder is polypropylene.

3. The roofing material of claim 1, wherein the meltable binder is used in the form of fibers.

4. The roofing material of claim 1, wherein said spunbond has a basis weight of 50–250 g/m$^2$.

5. The roofing material of claim 1, wherein said spunbond has a thickness of from 0.2 to 0.6 mm.

6. The roofing material as claimed in claim 1, wherein said spunbond has a breaking strength, measured on a 5 cm wide strip, of 10–25 daN.

7. The roofing material as claimed in claim 1, wherein said spunbond has an extensibility of 20–40%.

8. The roofing material as claimed in claim 1, wherein the spunbond bears an embossed pattern made up of randomly distributed or regularly repeating small plain-weave embossments in which the pressed area having thin, densified regions and nondensified regions, and wherein the thin, densified regions of the spunbond, accounts for 40–45% of the spunbond's total area and the spunbound has a thickness difference between densified and nondensified regions of 30–50%.

9. The roofing material as claimed in claim 2, wherein the spunbond has a basis weight of 80–120 g/m$^2$ and a thickness from 0.25–0.4 mm.

10. The roofing material as claimed in claim 1, wherein said meltable binder is polypropylene.

11. A roofing material comprising:

a) a bitumen and b) a spunbond of polyester filaments, wherein said spunbond being consolidated by a meltable binder whose melting point is 150° C. to 175° C. and wherein the polyester filaments have a filament linear density of 1–8 dtex and wherein said spunbond bears an embossed pattern made up of randomly distributed or regularly repeating small embossments having thin, densified regions and nondensified regions.

12. The roofing material of claim 11, wherein the meltable binder is polypropylene.

13. The roofing material of claim 11, wherein the meltable binder is used in the form of fibers.

14. The roofing material of claim 11, wherein the spunbond bears an embossed pattern made up of randomly distributed or regularly repeating small embossments having thin, densified regions and nondensified regions, and wherein the thin, densified regions of the spunbond, accounts for 30–60% of the spunbond's total area and the spunbond has a thickness difference between densified and nondensified regions of at least 25%.

15. The roofing material of claim 11, wherein the spunbond has a basis weight of 50–250 g/m$^2$.

16. The roofing material of claim 11, wherein the spunbond has a thickness of from 0.2 to 0.6 mm.

17. The roofing material of claim 11, wherein the spunbond has a breaking strength, measured on a 5 cm wide strip, of 10–25 daN.

18. The roofing material of claim 11, wherein the spunbond has an extensibility of 20–40%.

19. The roofing material as claimed in claim 14, wherein the spunbond bears an embossed pattern made up of randomly distributed or regularly repeating small plain-weave embossments in which a pressed area having thin, densified regions and nondensified regions, and wherein the thin, densified regions of the spunbond, accounts for 40–45% of the spunbond's total area and the spundbond has a thickness difference between densified and nondensified regions of 30–50%.

20. The roofing material as claimed in claim 12, wherein the spunbond has a basis weight of 80–120 g/m$^2$ and a thickness from 0.25–0.4 mm.

21. The roofing material as claimed in claim 11, wherein said spunbond of polyester filaments have a filament linear density of 1–8 dtex and which bears an embossed pattern made up of randomly distributed or regularly repeating small embossments having thin, densified regions and nondensified regions, and wherein the thin, densified regions of the spunbond, accounts for 30–60% of the spunbond's total area and the spunbond has a thickness difference between densified and nondensified regions of at least 25% and which meltable binder is present in the spunbond in a weight proportion of from 5 to 20% of the total weight of the spunbond.

22. The roofing material as claimed in claim 21, wherein said meltable binder is polypropylene.

* * * * *